United States Patent [19]

Cassidy et al.

[11] 4,016,445

[45] Apr. 5, 1977

[54] DEUTERIUM ARC LAMP

[75] Inventors: Robert L. Cassidy, Peabody; Robert J. Cosco, Amesbury; John A. Pappas, Winthrop, all of Mass.

[73] Assignee: GTE Sylvania Incorporated, Salem, Mass.

[22] Filed: Nov. 28, 1975

[21] Appl. No.: 636,325

[52] U.S. Cl. ..... 313/185; 313/223

[51] Int. Cl.[2] ..... H01J 61/12

[58] Field of Search ..... 313/185, 223

[56] References Cited

UNITED STATES PATENTS 2,953,705 9/1960 Cook ..... 313/223 X

*Primary Examiner*—R. V. Rolinec
*Assistant Examiner*—Darwin R. Hostetter
*Attorney, Agent, or Firm*—Edward J. Coleman

[57] ABSTRACT

A UV source comprising an arc lamp containing deuterium gas at an initial fill pressure in excess of that at which peak UV light intensity occurs, thereby extending the useful life of the lamp.

7 Claims, 6 Drawing Figures

DEUTERIUM ARC LAMP

BACKGROUND OF THE INVENTION

This invention relates to arc discharge lamps and, more particularly, to deuterium arc lamps.

Deuterium arc lamps provide an efficient source of ultraviolet (UV) light and have been found particularly useful in absorption spectroscopy equipment, particularly for biomedical applications. The typical range of the UV spectrum required for deuterium lamp analysis is from about 200 to 400 nanometers (nm), although in some instances wavelengths below 200 nm may be desired. Such applications require high UV intensities from uncontaminated sources. UV intensity is primarily a function of envelope material and thickness, with the purity of the envelope affecting the transmission characteristics. Parameters such as fill pressure and lamp geometry directly relate to UV intensity and define desired starting characteristics of the lamp. Typically, a current regulated supply operates the lamps at voltages between 65–95 volts, with the initial voltage for plasma breakdown being in the range of 250–350 volts. Starting is effected by heating a tungsten filament, typically coated with triple carbonate, to a temperature that provides sufficient thermionic emission to effect avalanching and plasma breakdown. Once the lamp ignites, the anode voltage drops from the initial 250–350 volt level to the above-mentioned 65–95 volt range.

Generally, there have been basic categories of deuterium arc lamps available having various life ratings. User specifications typically define a maximum of 50 percent reduction in intensity over the rated life of the lamp. Investigation has demonstrated that the loss of $D_2$ is one major cause for this intensity reduction, in addition to suspected losses due to emissive material deposited on the envelope in the viewing area.

SUMMARY OF THE INVENTION

Accordingly, it is an object of the present invention to provide an improved deuterium arc lamp.

It is a particular object to provide a deuterium arc lamp having an extended useful life.

These and other objects, advantages, and features are attained, in accordance with the principles of this invention, by providing an initial fill pressure of deuterium gas which is in excess of the fill pressure at which peak ultraviolet light intensity occurs during operation of the lamp. In particular, whereas conventional deuterium arc lamp design coincides peak intensity with initial fill level, we have discovered, quite unexpectedly, that the useful life of the lamp can be significantly extended by essentially providing an overfill of deuterium. For example, we find that by employing initial fill pressures between about 110 percent and 150 percent of the pressure at which peak UV intensity occurs, UV intensities within 50 percent of peak may be maintained for significantly extended periods of operation. We prefer to use initial fill pressures between about 140 percent and 150 percent of the pressure at peak UV to provide life ratings substantially higher than that of corresponding lamps with conventional fill pressures.

BRIEF DESCRIPTION OF THE DRAWINGS

This invention will be more fully described hereinafter in conjunction with the accompanying drawings, in which.

DESCRIPTION OF PREFERRED EMBODIMENT

Figure 3:
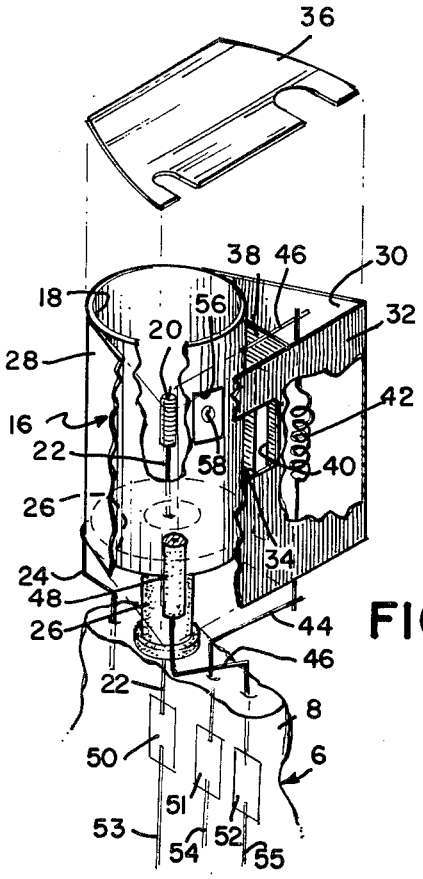
FIG. 3 is an exploded view of the structure within the lamp.
Figure 1:
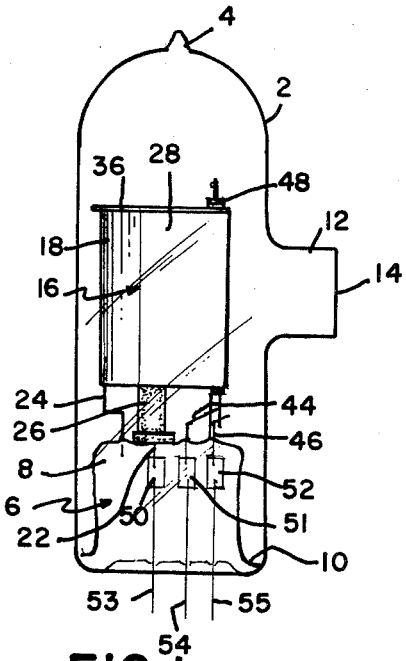
FIG. 1 is a side elevation of a deuterium arc lamp in accordance with the invention.
Figure 2:
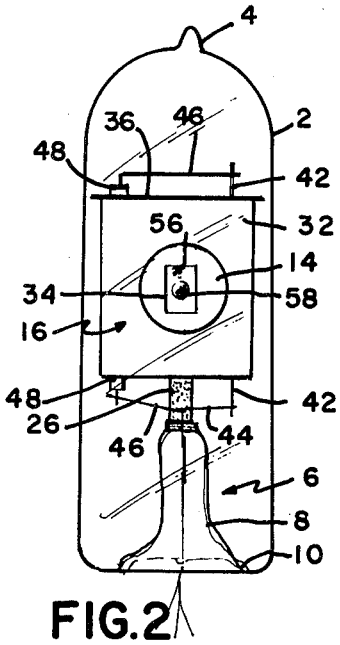
FIG. 2 is a front elevation of the lamp of FIG. 1.

As the present invention relates to a particular selection of fill pressure, it is applicable to a wide variety of lamp structures. One typical deuterium arc lamp construction is illustrated in FIGS. 1–3. The lamp envelope, or bulb, 2 has a generally tubular configuration with a dome-shaped top which is constricted to define an exhaust tip 4. The base of the envelope 2 is closed by stem portion 6 comprising an inverted press 8 having a flare 10 sealed to the base periphery of the tubular bulb. Before hermetically sealing the envelope, the lamp is filled with deuterium gas ($D_2$) as shall be described hereinafter. Typically, envelope 2 and stem 6 are formed of clear quartz, with at least a portion of the envelope comprising a material which is highly transmissive to ultraviolet light. For example, in the drawings, quartz envelope 2 is formed to have a horizontally projecting tubular portion 12 with an ultraviolet light-transmitting window 14 butt-sealed thereto. One material found particularly suitable for the UV window 14 is that referred to as Suprasil, available from Amersil Quartz Division of Englehard Industries, Inc. Suprasil is an isotropic, synthetic, fused silica with a high ultraviolet transmission down to 160 nm (for a 10 mm plate). It is bubble-free and has a high thermal and photochemical resistance.

Supported from the stem press within the envelope is a superstructure which houses the anode and cathode electrodes of the lamp. Referring particularly to FIG. 3, the superstructure 16 includes a tubular nickel housing 18 within which the anode 20 is coaxially disposed. Typically, anode 20 comprises a tungsten or molybdenum wire overwind or a molybdenum foil wraparound on the end of an anode lead-in wire 22. Housing 18 is supported by a wire 24, which is embedded at one end in press 8 and welded to the housing at the other end. The anode lead-in wire 22 is also sealed into press 8 and coaxially passes through a mushroom-shaped ceramic insulator 26 which closes the bottom of housing 18 and is supported on the top edge of press 8.

Superstructure 16 further includes a pair of nickel side walls 28 and 30 and a nickel front wall 32 having a rectangular aperture forming a light window 34. Substantially closing the top of the foregoing structure is a flat nickel cover 36.

A portion of the space bounded by walls 30 and 32 and housing 18 is partitioned off as a cathode-containing chamber by a nickel wall 38 having a rectangular slit referred to as a heater window 40. A cathode 42 is enclosed within this chamber and, in this instance, comprises a heater filament, such as a tungsten coil with a triple carbonate coating, supported by lead-in wires 44 and 46. Lead-in wire 44 is directly sealed into press 8, while lead-in wire 46 passes laterally over the superstructure, then vertically downward through a coaxially disposed tubular insulating member 48 to be sealed into press 8. Member 48 can be tightly wrapped in nickel tubing which is welded to wall 28, hereby providing a further support means for the superstructure. The internal lead-in wires 22, 44 and 46 are respectively connected within the press seal to molybdenum foil strips 50, 51 and 52, while the other ends of the foil strips are connected to external lead-in wires 53, 54 and 55, respectively. All the internal and external lead-in wires and support wire 24 comprise platinum-clad molybdenum wire. Attached to the sidewall of housing 18 is a rectangular piece of molybdenum, referred to as a concentrator 56, which has a mirror-like surface and defines an orifice 58 surrounded by a smooth depression. During operation of the lamp, an arc discharge path is defined between the anode 20 and cathode 42 via orifice 58 and heater window 40. Accordingly, the orifice 58, disposed between the cathode and anode, functions to confine the diameter of the arc discharge therebetween. The orifice 58, which may be in the order of one millimeter in diameter, is an alignment with the light window 34 and UV window 14, whereby during operation of the lamp, a nearly point source of UV light is provided therethrough.

The above description relates to but one typical embodiment of the lamp structure. We have obtained a life rating of 500 hours with such a lamp construction by using higher deuterium fill pressures in accordance with the invention. Another type envelope structure that has been employed provides the UV transmitting portion by butt-sealing a tubular section of Suprasil between a quartz dome and tubular base portion. The internal structure of this alternative type lamp comprises a cathode filament surrounded by a nickel cylinder with an orifice; the anode is a rectangular piece of molybdenum with an orifice to correspond to that of the cathode. The filament, rather than being a coil, comprises a nickel screen, or mesh, in the form of a corrugated strip having a triple carbonate coating. By employing higher fill pressures according to the invention, we have provided a 200-hour life rating with this alternative lamp construction.

Figure 4:
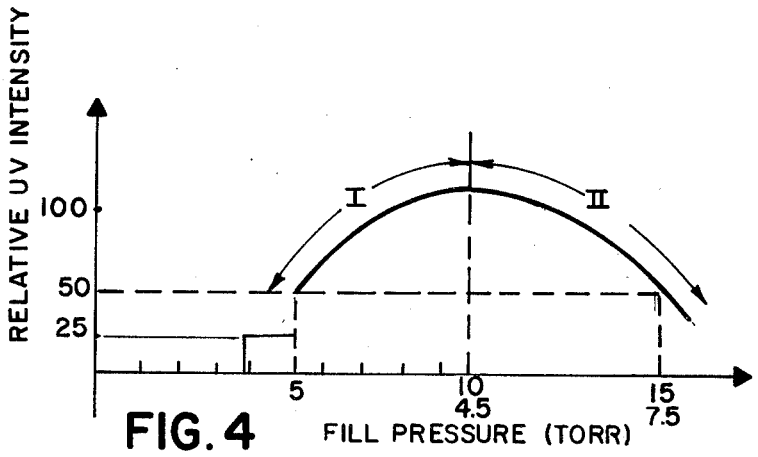
FIG. 4 shows a simplified curve of relative UV intensity versus initial fill pressure for two different type lamps (as represented by the two sets of values along the x-axis)
Figure 5:
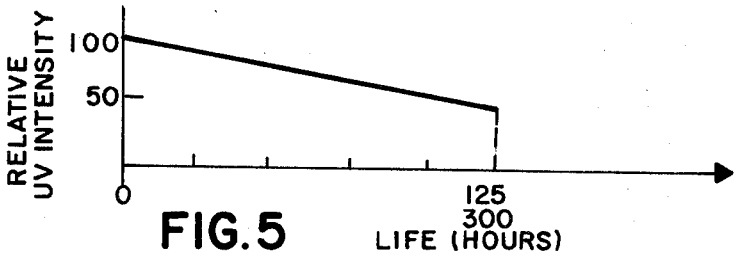
FIG. 5 shows a simplified curve of relative UV intensity versus operative life in hours for two different type lamps having a conventional initial fill pressure; and, FIG. 6 shows a simplified curve of relative UV intensity versus operating life for two different type lamps having a pressure overfill according to the invention.

Referring now to the curve of FIG. 4, it will be observed that over section I of the curve, the UV light intensity increases as the initial fill pressure of the lamp increases. According to conventional design, the final fill pressure of $D_2$ initially provided in the lamp was selected to correspond with peak UV intensity. Thus, for the case of the lamp of FIGS. 1–3, the conventional design for initial fill pressure of $D_2$ would be about 4.5 torr, at which point the relative UV intensity peaks, and for the alternative lamp construction briefly described, the conventional design for fill pressure would be about 10 torr. Thereafter, over the operating life of the lamp, intensity gradually decreases as the deuterium is dissipated by the reduction of oxides in the cathode coating or those formed in the metal parts during fabrication. This degradation of intensity over operating life is illustrated in FIG. 5 for the case of conventional lamps. More specifically, for the lamp of FIGS. 1–3 having a fill pressure of 4.5 torr at zero hours, there will be in the order of a 50 percent degradation of UV intensity after about 300 hours. That is, the useful life, or life rating, of a conventional lamp of this type is about 300 hours. The alternative lamp construction, having a conventional fill pressure of 10 torr. at zero hours, would have a 50 percent degradation point after about 125 hours of operation, thus yielding a 125-hour life rating.

Figure 6:
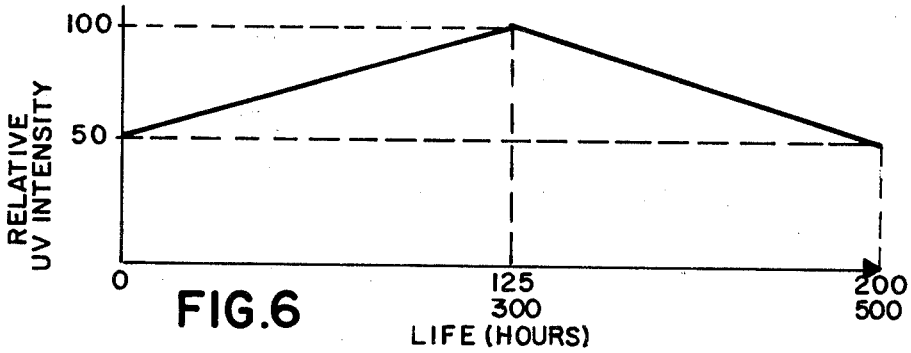

Referring again to FIG. 4, we have discovered, in accordance with the invention, that by providing a D pressure overfill to a point below the peak UV intensity level, i.e., to a point on Section II of the curve, the useful life of the lamp is substantially extended. For example, consider the lamp of FIGS. 1–3 that exhibited a peak UV intensity at 4.5 torr; if we overfill to a point which generates 50 percent of the originally disposed peak intensity, in this instance to a pressure of 7.5 torr, we find that it takes about 300 hours to reduce the deuterium content to the point where intensity is double the initial level, i.e., the UV intensity grows from 50 percent of peak to the peak intensity. Thereafter, it takes 200 hours to again drop to the 50 percent intensity level. As illustrated in FIG. 6, this extends the useful life of the previously rated 300-hour lamp to 500 hours. Thus, by employing an initial fill pressure in excess of that at which peak UV light intensity occurs during lamp operation (in this instance a fill pressure which is about 167 percent of the pressure at peak intensity), the rated life is extended to 500 hours.

With respect to the alternative lamp construction having a peak UV intensity at 10 torr, if we overfill to a point which generates 50 percent of the originally designed peak intensity, in this instance to a pressure of 15 torr, we find that it takes about 125 hours to reduce the deuterium content to the point where intensity is double the initial level, i.e., the UV intensity grows from 50 percent of peak to the peak intensity. Thereafter, it takes 75 hours to again drop to the 50 percent intensity level. As illustrated in FIG. 6, this extends the useful life of the previously rated 125 hour lamp to 200 hours. Thus, by employing an initial fill pressure which is about 150 percent of the pressure at peak intensity, the rated life is extended to 200 hours.

The overfill pressure may range between about 110 percent and 170 percent of the pressure at which peak ultraviolet light intensity occurs, although we prefer overfill pressures between 140 percent and 170 percent of the pressure at peak intensity. Further, lamps with envelopes consisting entirely of quartz may also be employed.

Hence, although the invention has been described with respect to a specific embodiment, it will be appreciated that modifications and changes may be made by those skilled in the art without departing from the true spirit and scope of the invention.

What we claim is:

1. A deuterium arc lamp comprising:

an hermetically sealed envelope having an ultraviolet light-transmitting portion;

a pair of electrodes in said envelope between which an arc discharge path is defined during operation of said lamp; and deuterium gas in said envelope at an initial fill pressure in excess of that at which peak ultraviolet light intensity occurs during operation of said lamp, whereby the useful life of said lamp is substantially extended.

2. The lamp of claim 1 wherein said initial fill pressure is between about 110 percent and 170 percent of the pressure at which peak ultraviolet light intensity occurs.

3. The lamp of claim 2 wherein said initial fill pressure is between about 140 percent and 170 percent of the pressure at which peak ultraviolet light intensity occurs.

4. The lamp of claim 1 wherein one of said electrodes comprises a cathode filament and the other electrode comprises an anode, and further including means disposed between said cathode and anode which defines an orifice for confining the diameter of the arc discharge therebetween, said orifice being in alignment with the ultraviolet light-transmitting portion.

5. The lamp of claim 4 wherein said initial fill pressure is between about 140 percent and 170 percent of the pressure at which peak ultraviolet light intensity occurs.

6. The lamp of claim 4 wherein said envelope comprises a quartz bulb.

7. The lamp of claim 6 wherein the ultraviolet light-transmitting portion of said envelope comprises an isotropic fused silica window sealed onto said quartz bulb.

* * * * *